US006522853B2

(12) United States Patent
Iida et al.

(10) Patent No.: US 6,522,853 B2
(45) Date of Patent: Feb. 18, 2003

(54) IMAGE PRINTING METHOD AND IMAGE PRINTING APPARATUS

(75) Inventors: Atsuko Iida, Kanagawa (JP); Norio Yoshikawa, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/950,626

(22) Filed: Sep. 13, 2001

(65) Prior Publication Data

US 2002/0031372 A1 Mar. 14, 2002

(30) Foreign Application Priority Data

Sep. 13, 2000 (JP) ..... 2000-278491

(51) Int. Cl.[7] ..... G03G 15/10; G03G 15/11
(52) U.S. Cl. ..... 399/249; 399/49; 399/251
(58) Field of Search ..... 399/249, 251, 399/237, 233, 53, 57, 72, 46, 49

(56) References Cited

U.S. PATENT DOCUMENTS 4,259,006 A 3/1981 Phillips et al.
6,219,500 B1 * 4/2001 Byun ..... 399/249

FOREIGN PATENT DOCUMENTS

JP 61-77866 * 4/1986
JP 4-1774 1/1992
JP 4-46426 7/1992
JP 10-10874 1/1998

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

Disclosed is a method and apparatus for printing an image on a print medium with a liquid developer which comprises a liquid carrier and a toner dispersed in the liquid carrier. The printing method has: forming a toner image probably containing the liquid carrier, from the liquid developer; removing the liquid carrier from the toner image; transferring the toner image to the print medium; projecting light radiation on the toner image to be transferred, to measure the optical reflection from the toner image to be transferred; and estimating transfer suitability of the toner image to be transferred, by means of the measured optical reflection from the toner image to be transferred, for appropriately controlling the extent of the removing of the liquid carrier. The printing apparatus has an optical instrument which projects light radiation on the toner image to be transferred and measures the optical reflection from the toner image to be transferred, in order to appropriately control the carrier remover.

19 Claims, 4 Drawing Sheets

IMAGE PRINTING METHOD AND IMAGE PRINTING APPARATUS

BACKGROUND OF THE INVENTION

1. Field of the Invention

The present invention relates to an image printing method and image forming apparatus, in which an image is formed with use of a liquid developer, more particularly, to an image printing method and image printing apparatus for which operational conditioning is easily and simply adjusted so that an image formed by an electrophotography technology is transferred successfully.

2. Related Art

From the standpoint of developers used, electrophotography technologies are classified into those of dry development using a solid developer and those of wet (liquid) development using a liquid developer. In conventional electrophotography technologies, wet development is believed to be disadvantageous practically because of some substantial problems, and consequently, the field of image formation by electrophotography technologies has been long occupied substantially by dry development.

However, electrophotography of wet development has also an advantage which can not be realized by dry development. Specifically illustrated are: since an extremely fine toner of sub-micron size can be used, high image quality can be realized; since sufficient image concentration is obtained with a small amount of toner, an economical merit is obtained and texture corresponding to offset printing or other like printing can be realized; since a toner can be fixed to paper at relatively lower temperature, energy saving and high speed output can be realized: and the like. Based on these facts, in recent years, the value of electrophotography based on wet development has been reviewed and development is in progress aiming at practical use.

In a wet mode image printing apparatus, visible images developed on a photosensitive body contains a surplus mount of carrier solvent. Therefore, removal of as much surplus carries as possible before transfer is a significant problem for obtaining good transferred images.

U.S. Pat. No. 4,259,006, Japanese Patent Application Publication No. 4-46426 and Japanese Patent Application Laid-Open (JP-A) No. 4-1774 disclose methods of removing off surplus carriers. In these methods, a surplus amount of carrier solvent on developed images is scraped off by a squeeze roller and blade placed adjacent to or in contact with a photosensitive body, then, a remaining surplus developer is further dried by blow of air. However, practically, if drying of a developed image is insufficient, a remaining solvent tends to cause disturbance in a transferred image, and transfer failure also occurs frequently. Inversely, if drying progresses too much, transfer failure still tends to occur frequently, namely, optimization of the dry condition of developed images before transfer is not easy. Particularly, if the thickness of a toner layer of a developer is large, disturbance of a transferred image and transfer failure tend to occur, Also in the suggestion of the above-described publication, such problems remain unsolved.

On the other hand, Japanese Patent Application Laid-Open (JP-A) No. 10-10874 discloses an apparatus equipped with a spray nozzle for supplying a solvent again to images after drying, as shown in FIG. 1. In this apparatus, an electrostatic latent image formed by an electrostatic charger 2 and an exposing apparatus 3 on a photosensitive drum 1 is developed using a development roller 8, then, a remaining solvent is scraped off by a squeeze roller 9, and a toner is fixed by a set roller 10, then, dried by drying means 12. The dried toner image receives spraying with a solvent 23 transported from a solvent tank 22 to a spray nozzle 21, then, is transferred onto a transfer material 7 by a transfer roller 11 at transfer position 5.

However, the above-described method has a disadvantage that the printing apparatus becomes complicated and large for incorporating the measures for supplying a solvent before transfer. Further, since the amount of agglomerated developer (toner) on a developed image differs depending on the tone and concentration of an image to be formed, the developed image naturally has a local difference in the amount of the agglomerated toner which occurs depending on what image is developed. Accordingly, also the amount a solvent evaporated from a developed image and the degree of drying the developed image varies locally depending on the image. Therefore, if a solvent in amount suitable for a thick developed image which is liable to cause excessive drying is fed over the whole region of the developed image, it leads to excess feeding for other thinner images. Namely, it is difficult to prevent, over the whole image region, the excess amount of a solvent from being fed, as compared with the amount of a solvent dried and removed from the image. Consequently, on developed images once revealed excess drying, it is difficult to make the dried condition suitable for transfer over the whole developed image region by feeding of a solvent as in the above-described publication.

As described above, in the conventional wet electrophotography image formation, there is no practical means for grasping the dried condition of a developed image on a photosensitive body, and it is therefore difficult to effect suitable removal of a surplus carrier solvent necessary for attaining good transfer, and a problem occurs that decrease in transfer efficiency due to disturbance of a transferred image and transfer failure is caused.

SUMMARY OF THE INVENTION

With these problems in mind, therefore, it is the primary object of the present invention to provide a novel electrophotography image forming method and an apparatus which can control the motion of an image forming system so that an image is transferred under dry condition suitable for transfer, in order to realize constant good transfer.

Another object of the present invention is to provide an electrophotography image forming method and an apparatus which detect condition suitable for transfer by measuring an element useful as a criterion for the condition of an image, can control drying operation based on this condition, and can realize good transfer property and image output of high image quality.

In order to achive the above-mentioned object, a method of printing an image on a print medium with a liquid developer which comprises a liquid carrier and a toner dispersed in the liquid carrier, according to the present invention, comprises: forming a toner image probably containing the liquid carrier, from the liquid developer; removing the liquid carrier from the toner image; transferring the toner image to the print medium; projecting light radiation on the toner image to be transferred, to measure the optical reflection from the toner image to be transferred; and estimating transfer suitability of the toner image to be transferred, by means of the measured optical reflection from the toner image to be transferred, for appropriately controlling the extent of the removing of the liquid carrier.

A printing apparatus for printing an image onto a print medium with use of a liquid developer which contains a liquid carrier and a toner being dispersed in the liquid carrier, according to the present invention, comprises: an image forming system which forms a toner image probably containing the liquid carrier, from the liquid developer: a carrier remover which removes the liquid carrier from the toner image, the carrier remover being controllable to change the extent of removing the liquid carrier; a transfer member which transfers the toner image from the image forming system to the print medium; and an optical instrument which projects light radiation on the toner image to be transferred and measures the optical reflection from the toner image to be transferred, in order to appropriately control the carrier remover.

BRIEF DESCRIPTION OF THE DRAWINGS

The features and advantages of the method and the apparatus for printing images according to the present invention over the proposed image printing techniques will be more clearly understood from the following description of the preferred embodiments of the present invention taken in conjunction with the accompanying drawings in which like reference numerals designate the same or similar elements or sections throughout the figures thereof and in which.

DETAILED DESCRIPTION OF THE PREFERRED EMBODIMENTS

Figure 1:
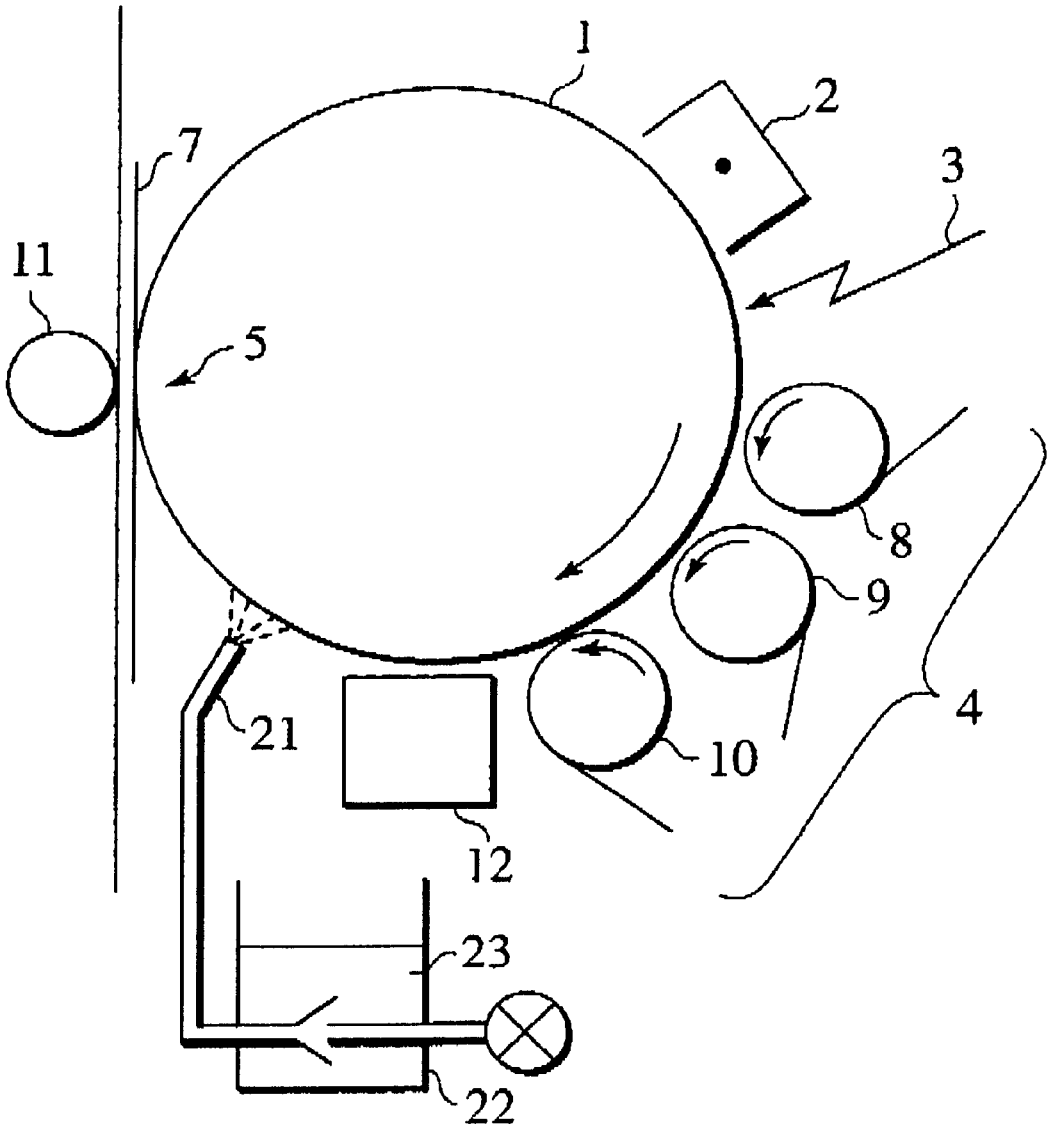
FIG.1 PRIOR ART
FIG. 1 is a schematic configuration view showing a conventional electrophotography image forming apparatus.

Image printing by electrophotography using a liquid developer is attained by processes of: forming an electrostatic latent image on a photosensitive layer by effecting light exposure, corresponding to images to be formed, on the surface of a charged photosensitive layer and eliminating charge on the exposed part; developing the electrostatic latent image with a toner by feeding on the surface of the photosensitive layer a liquid developer prepared by dispersing a toner having electrostatic charge in a carrier composed of insulating liquid (organic solvent), namely, a developing liquid; removing an unnecessary carrier; and transferring the developed image to a print medium (recording medium such as paper and the like) from the photosensitive layer. In the case of a colored electrophotography, all of these processes are repeated on each of four colors, yellow (Y), magenta (M), cyan (C) and black (Bk). Alternatively, formation of an electrostatic latent image, development and removal of an unnecessary carrier may be conducted on each color to form full color images on a photosensitive layer, and then a transfer process is conducted.

The efficiency of transfer of an image onto a print medium differs depending on the condition of the image formed on a photosensitive body just before transfer. Then the inventors of this application carried out various experiments on physical properties of developed images which are obtained by measurement and efficiency of transfer of the developed images, for understanding the conditions suitable for the transfer of an image. As a result, a correlation has been found between the optical reflection quantity of a developed image and the transfer efficiency of the image. Utilizing this correlation, suitability of the image for transfer can be determined by measurement of the optical reflection quantity of an image, and the image printing system can be so controlled that all image is transferred under condition suitable for transfer.

The present invention will be explained in detail below.

When an electrostatic latent image on a photosensitive body is developed using a liquid developer, if the photosensitive body is then dried by air of constant flow rate, drying of the image progresses according to the lapse of time. When change by time is checked by measuring the optical reflection quantity of an image in this progress, the optical reflection quantity decreases steeply at the initial period (hereinafter, referred to as a descending period. See the period A in FIG. 4.), however, after this period, the optical reflection quantity starts to reveal increase (referred to as the minimum period. See the period B in FIG. 4.), increases tenderly (referred to as an increasing period, See the period C in FIG. 4), leading to an approximately constant value (referred to as an asymptotic period. See the period D in FIG. 4.). Then, if the relationship between the drying time and the transfer efficiency of an image is measured by effecting transfer of the image as described above, an image in the decrease period includes a lot of transfer failures and manifests low transfer efficiency, however, near the minimum period, the transfer efficiency increases, and in the increase period, the transfer efficiency is maintained at high level and good transfer of 90% or more transfer efficiency is possible. Even in the asymptotic period, high transfer efficiency is maintained, excepting that, if drying is continued excessively for a long period of time, an image reveals transfer failures.

It is considered that an image in the descending period is under condition in which a solvent is present on the surface of a toner layer, an image in the minimum period is under condition in which a solvent on a toner layer is lost, and images in the increasing period and the asymptotic period are under condition in which a solvent contained in a toner layer decreases. In other words, the optical reflection quantity decreases due to decrease of a solvent on a toner layer, and the optical reflection quantity then approaches that of a dry toner layer due to decrease of a solvent in a toner layer. Since a solvent present on the surface of the toner layer tends to disturb transfer of the toner, high transfer efficiency is obtained by continuing drying until a solvent on the toner layer is lost.

This phenomenon on the graphic curve is likewise observed even if the drying speed of a photosensitive body and the wavelength of light radiation for measuring optical reflection quantity are changed. Moreover, the same phenomenon is observed even in a ease of a different toner color, and the difference depending on the color of toner is that the level of the optical reflection quantity detected varies over the whole range. Therefore, transfer efficiency can be maintained high by previously making a curve of optical reflection quantity of developed images as a calibration chart according to the above method, and controlling the image drying system using the measured value of optical reflection quantity so that an image immediately before transfer is in the state of the minimum period or the periods following thereto, preferably under the condition of the increasing period. The level of optical reflection quantity is highest at yellow and falls when the color changes to magenta and cyan, in this order. Determination or judgement of the image condition by detecting the optical reflection quantity of toner is relatively easy in a yellow color.

A period during which high transfer efficiency is kept among the asymptotic period differs depending on various conditions of the toner image (properties of the toner and the like) and transfer mode, and it is longer in the case of indirect transfer than in the case of direct transfer in which transfer efficiency is substantially low. From these facts, if such control is effected that the optical reflection quantity in the increase period is obtained, high reliability is obtained in any case.

In the case of an image formed of toners of a plurality of colors, the measured value of optical reflection quantity is obtained as an average value in the irradiated area, and manifests the same change as described above. Good transfer property is also obtained in the states of the minimum period and the subsequent periods, particularly, under the condition of the increasing period.

In such an image pattern of which most parts are occupied by regions in which toners of a plurality of colors are overlapped and the thickness of the image is increased, an good transferred image is obtained by setting the power and time period for drying before transfer so that the optical reflection quantity measured is a value of the increasing period that is somewhat lower than the value (referred to as asymptotic value) to which the optical reflection quantity approximates in the asymptotic period. For example, an image of the maximum concentration can be successfully transferred by previously obtaining an optical reflection quantity curve which is made by measuring the optical reflection quantity of a toner image obtained by developing an image pattern of the maximum concentration while overlapping images of liquid developers of four colors, and by setting drying power and drying time period so that the optical reflection quantity of an image immediately before transfer approaches a value of best suitability that is about 60% while regarding the minimum value of optical reflection quantity as 0% and the asymptotic value thereof as 100% (accordingly, a suitable value=0.80×(asymptotic value−minimum value)+minimum value). In this time, an image of lower concentration, of course, shows high transfer efficiency as well.

The range of the optical reflection quantities at which a preferably transferred image is possibly obtained changes depending on how much proportion of visible images in the image pattern is occupied by regions in which toners of four colors were overlapped and the thickness of the toner layer was high. For example, in a case of an image having high concentration, since it contains a large amount of solvent when it is developed on the photosensitive body, the image being dried to manifest an optical reflection quantity being in the vicinity of the minimum value is not suitably transferred due to insufficient drying. If such an image is further dried to manifest high optical reflection quantity near the asymptotic value, it is not suitably transferred due to cracking easily caused on the image surface. Accordingly, in the case of an image pattern formed wholly of thick images which are made of overlapped toners of four colors and having a highest concentration, it is desired to transfer the image at such a dried state that the optical reflection quantity is within a range of 40 to 60%. In contrast, in a case of a monochromatic image pattern having a low concentration, the extent of drying rather advances in the state having an optical reflection quantity in the vicinity of the minimum value, and a suitably transferred image is obtained in a wide range of optical reflection quantity up to the asymptotic value. Therefore, in actual setting of image transferring timing, it is possible to determine the mark of the optical reflection quantity for suitably transferring the toner image, in view of the proportion of toner images of high concentration to the whole visible images, and it is possible to provide suitable transferring of toner images by aiming at the optical reflection quantity in a range of 30 to 80%.

As described above, an image of high image quality having stable and good transfer property can be constantly formed by controlling the drying conditions so that the optical reflection quantity of an image on the photosensitive body immediately before transfer is in a range from the value of the minimum period to that of the increasing period.

Since operation of removing a surplus liquid carrier from the developed image requires a longer time if the operation is conducted only by drying, it is efficient that a part of a remaining carrier solvent is removed by a squeeze or absorption member placed adjacent or in contact with a photosensitive body, and the solvent is then further removed by a drying mechanism, to continue drying until leading to the state showing optical reflection quantity within the range which can obtain good transfer property as described above. In this case, the degree of freedom in controlling vaporization by a drying mechanism also increases. Moreover, control of the degree of drying becomes easy, leading to an advantage also in energy saving.

Since the surface of common paper is relatively rough, an image formed in an image printing apparatus easily causes transfer unevenness at direct transfer to paper, due to variation in electric field derived from concave and convex on the surface of paper as well as transfer failure due to irregularity of electric property of paper. Consequently, there occurs a need of using a print medium having a smooth surface such as art paper and the like. On the other hand, if a transfer medium such as an intermediate transfer roller and the like is used to once maintain the image on the transfer medium, and if the image is transferred to the print medium while imparting pressure and/or heat to the image, the transfer efficiency can be improved owing to offset effect to prevent transfer failure. An image of high quality can be easily obtained as well. Therefore, a period during which transfer efficiency is high in the above-described optical reflection quantity curve is also elongated than in the case of direct transfer, and a period during which transfer efficiency is high in the asymptotic period also changes depending on the conditions for indirect transfer.

The present invention will be described further in detail below, referring to embodiments of the electrophotography image printing apparatus according to the present invention. Members and parts having the same or equivalent functions are represented by the same marks, and repeated explanations on the same actions will be omitted.

Figure 2:
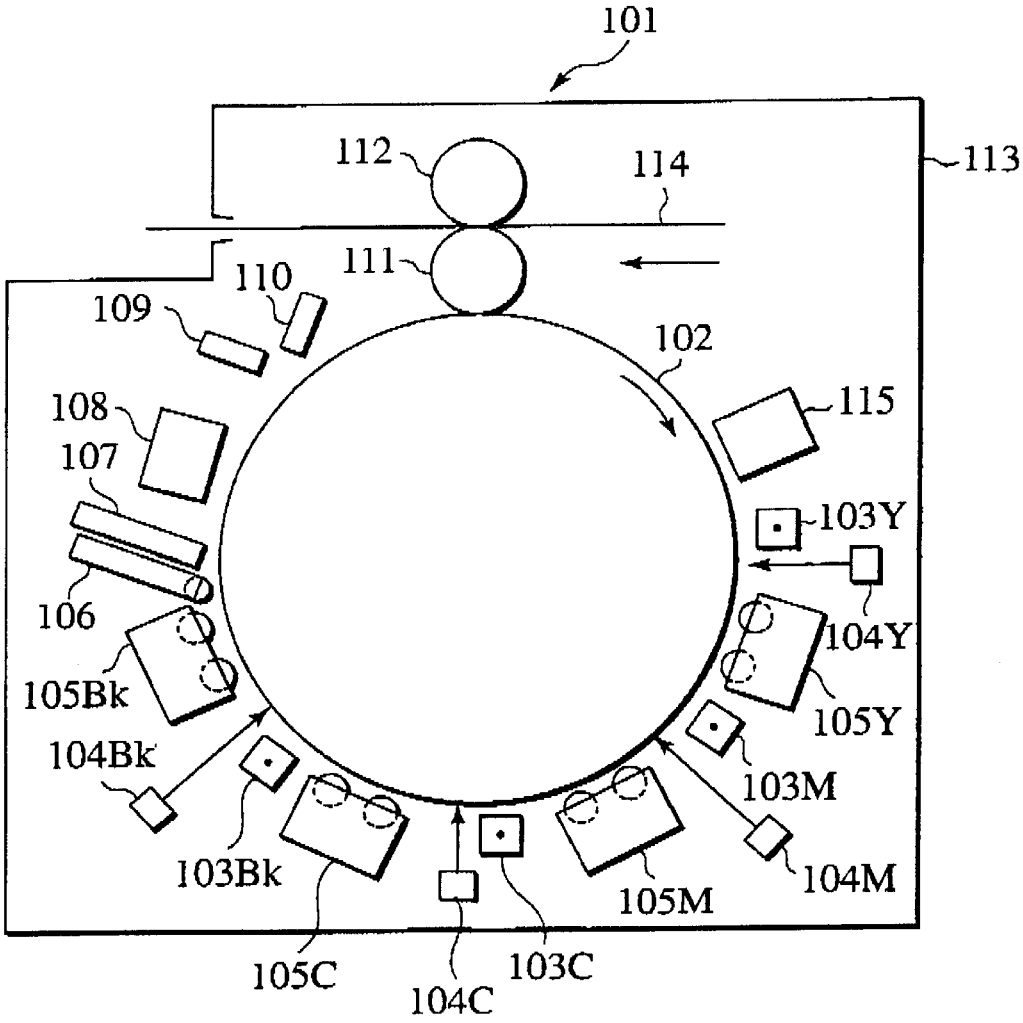
FIG. 2 is a schematic configuration view showing one embodiment of an electrophotography image printing apparatus of the present invention.

FIG. 2 is a view showing schematic configuration of an embodiment of the electrophotographic image printing apparatus according to the present invention. This electrophotographic image printing apparatus 101 has a photosensitive body 102 carrying on the outer peripheral surface thereof a photosensitive layer which forms and maintains a latent image, electrostatic chargers 103Y, 103M, 103C and 103Bk for uniformly charging a photosensitive layer, exposure apparatuses 104Y, 104M, 104C and 104Bk for forming on the photosensitive layer an electrostatic latent image corresponding to an image to be printed, developing units 105Y, 105M, 105C and 105Bk for supplying a liquid developer on a photosensitive layer and developing an electrostatic latent image, a liquid removing member 106 for removing a portion of a surplus solvent on the photosensitive body, a drying mechanism 107 for vaporizing a solvent contained in the developed image, a solvent recovering device 108 for recovering the vaporized solvent, an irradiator 109, a light receiving sensor 110, a transfer roller 1 and press roller 112, and a housing 113 for receiving them.

The photosensitive body 102 has a photosensitive layer made of a material such as organic materials or amorphous silicon-based materials, on a conductive substrate in the form of a drum, and it is charged uniformly by the electrostatic charger 103Y by corona electrical charging or scorotron charging and the like. Then it receives light exposure by laser beam, LED or the like which has been image-modulated for a yellow image from the exposure apparatus 104Y, and charge in the exposure part disappears to form an electrostatic latent image on the surface of a photosensitive layer. After this procedure, a liquid developer is fed to the photosensitive layer from the developing unit 105 containing a liquid developer, and toners having electrostatic charge contained in the liquid developer are concentrated on charged part or non-charge part of the electrostatic latent image, and visualization of the electrostatic latent image, namely, development is conducted to form a yellow toner image. In the developing unit 105Y, most of a surplus carrier solvent on the photosensitive layer is removed by a squeeze roller placed at a slight interval (about 20 to 50 $\mu$m) near the photosensitive body 102.

Subsequently, full color toner images are formed on the photosensitive body 102, by repeating the same procedure as described above on image of magenta, cyan and black, by the electrostatic chargers 103M, 103C and 703Bk, exposure apparatuses 104M, 104C and 104Bk and developing units 105M, 105C and 105Bk. In the case of a monochrome image, these members and repetition of the operation are omitted.

The toner of the developed toner image contains a surplus amount of solvent which is removed by a liquid removing member 106, and at remaining solvent is further evaporated by the drying mechanism 107. For the liquid removing member 106, it is possible to use a sponge-like member exhibiting absorption to the solvent. Alternatively, a roller formed of a lipophilic material such as silicone rubber and the like may be placed in contact with a photosensitive body. The drying mechanism has a nozzle for blowing air onto the surface of the photosensitive body 10, and if necessary, the flow rate and temperature of air can be controlled. The vapor of solvent evaporated from the top of the photosensitive body 102 is recovered by the solvent recovering device 108, and the image after drying is transferred to the transfer roller 111, then, pressed and fixed to the print medium 114 such as paper and the like by the press roller 112. Constituent materials are so selected that the stickiness on the surface of the transfer roller 111 is higher than that on the surface of the photosensitive body 102. By applying heat to a toner image on the transfer roller 111, transfer to the print medium becomes more successful. After transfer, the surface of the photosensitive body 102 is cleaned by the cleaner 115.

The electrophotographic image printing apparatus 101 has further an irradiator 109 for irradiation onto the toner image immediately before the transfer and a sensor 110 for detecting optical reflection from the toner image, in order to determine whether the image after drying is on a suitable condition for transfer. Using these devices, as described above, the optical reflection quantity of the toner image to be transferred is checked, and the drying mechanism 107 is controlled so that the state of the toner image before transfer is in the minimum period or the following period, preferably, in the increasing period. Examples of the irradiator 109 include laser irradiators and the like such as a semiconductor laser but are not limited to them, and light sources showing small absorption in the irradiation wavelength region of the exposure apparatus used for irradiation of the photosensitive body 102 can be used, in regard to the sensor 110, those which may be permissible in the irradiation wavelength region of the irradiator 109 can be used.

Since the above electrophotographic image printing apparatus 101 into which the irradiator 109 and the sensor 110 are integrally incorporated can check the dring condition of a toner image constantly, it is also possible to automatically control the regulation of the drying mechanism by further using an operation control unit which is connected to the sensor 110. In this case, the drying condition of a visible image can be detected and fed back for the output of the drying mechanism. Therefore, if a plurality of drying mechanism (blow nozzles, etc.) and a plurality of couples of irradiators and light quantity sensors are placed alternately after development of each developer, conditioning of the tonier image is further improved to increase correctness, leading to uses suitable for fields in which images of extremely high preciseness are needed. Moreover, it is also possible to place the sensor 110 between the liquid removing member 106 and the drying mechanism 107, and dry condition after passing through the liquid removing member is detected and fed back for the output of the drying mechanism.

Figure 3:
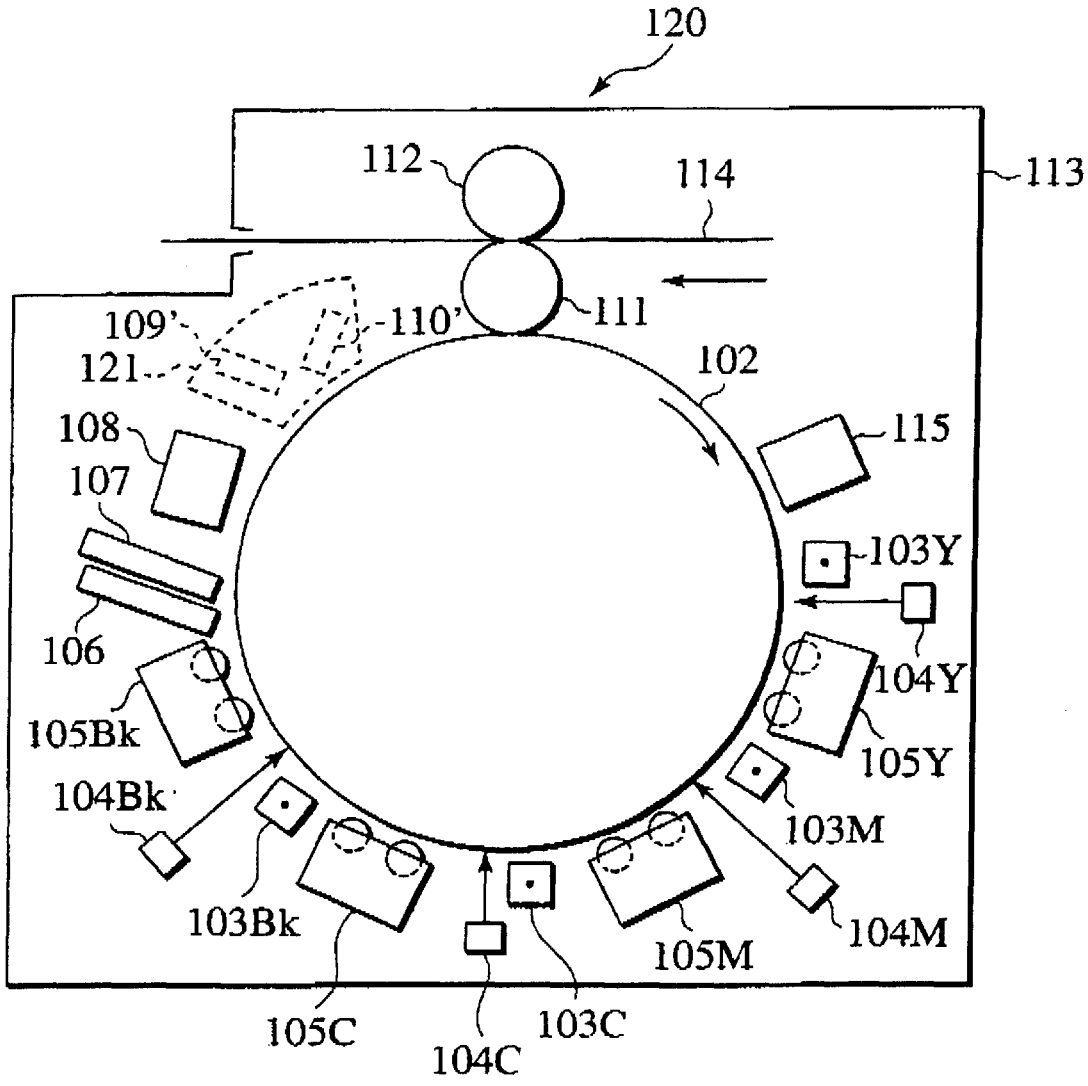
FIG. 3 is a schematic configuration view showing another embodiment of oil electrophotography image forming apparatus of the present invention.

In the case of image printing at preciseness generally required, regulation of the drying mechanism may also be limited to conduct only at maintenance and check. In such a case, it is not usually required that an image printing apparatus has the irradiator 109 and the light quantity sensor 110 placed. Therefore, as shown in FIG. 3, it is possible that an irradiator 109' and a light quantity sensor 110' are temporarily set, before use of the electrophotography image printing apparatus 120 having no irradiator and light quantity sensor, or at necessary time such as maintenance and check thereof and the like, and control of the drying mechanism 7 is conducted so that an good transfer property is obtained. Moreover, if the irradiator 109' and light quantity sensor 101' are made into a checking cartridge 121, works for maintenance and check are easy.

Moreover, the relationship between the optical reflection quantity of the toner image and drying condition and transfer efficiency thereof is not restricted in electronic printing, and observed commonly in images using liquid developers prepared by dispersing a toner in a liquid carrier, therefore, dry condition can be checked by using the optical reflection quantity from the toner image according to the present invention not only in image formation by electrophotography but also in image formation of other types.

EXAMPLES

Example 1

A resin composition prepared by adding a coloring pigment (yellow) and a charge controlling agent to a thermoplastic resin having a glass transition point of 45° C. was granulated to obtain resin particles having an average particle size of about 0.2 $\mu$m, and the resin particles were dispersed in a petroleum-based insulation solvent (manufactured and sold by Exxon Co. with the trade name, "Isopar L") to make a yellow liquid toner.

Next, as shown in FIG. 3, the irradiator 109' and the sensor 110' were mounted on an electrophotographic image printing apparatus 120, and the following operation was conducted.

Figure 4:
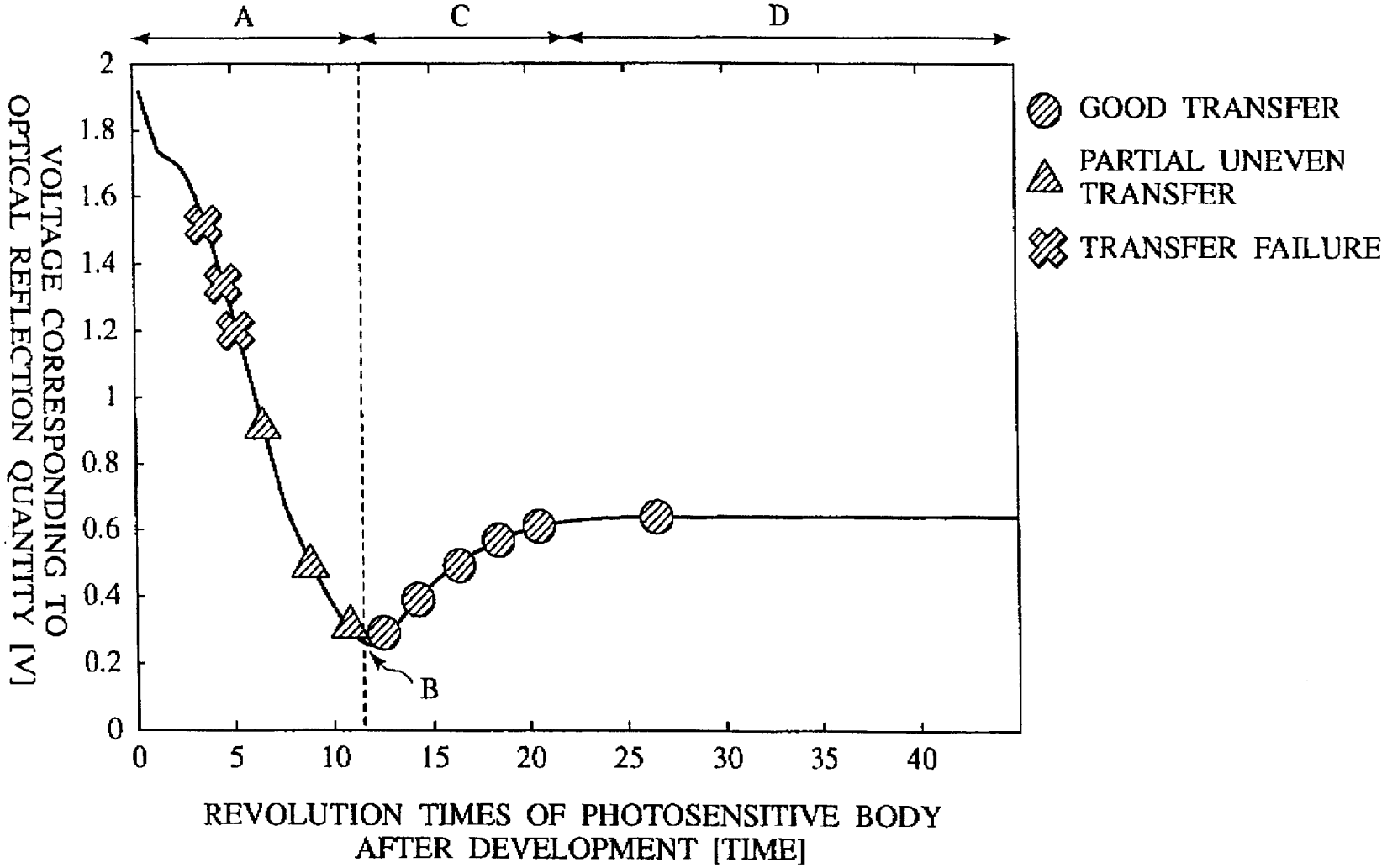
FIG. 4 is a graph to explain the relationship between the drying time and the quantity of optical reflection from a developed image.

The photosensitive body 102 was rotated at a speed of about 220 mm/sec, and development was conducted with the liquid toner on the surface of the photosensitive body. Part of a surplus amount of solvent was removed by the liquid removing member 106 composed of a sponge roller made of urethane rubber and placed in contact with the photosensitive body 102, directly after development, dry air was then blown at a wind rate of 0.4 $m^3$/min. from an air knife placed adjacent to the photosensitive body 102 as the drying mechanism 107, to visible images on the photosensitive body, to evaporate forcibly the surplus developer. Laser light having a wavelength of 780 nm was irradiated from the irradiator 109' while effecting control so that transfer of the transfer roller 11 did not occur, and the optical reflection quantity of the visible image were measured by the sensor from directly after development. The relationship between the number of revolutions of the photosensitive body and the optical reflection quantity from images, after development, was checked. The results are shown in FIG. 4, wherein the ordinate of the FIG. 4 shows the output voltage of the sensor corresponding to the optical reflection quantity, and the abscissa shows the number of revolutions of the photosensitive body (drying time of the image).

Further, transfer was performed onto paper 114 (normal paper) while controlling the transfer roller 111 so that the photosensitive body was rotated for predetermined revolution number after development and before transfer. In this operation, the transfer roller 111 was maintained at 100 ° C. and the total load thereof was set at 50 kg, and the press roller 112 was maintained at 100° C. and the total load thereof was set at 50 kg. The transfer efficiency of the images transferred to the paper 114 was checked, wherein transfer efficiencies of 90 to 100% were evaluated as "good transfer", transfer efficiencies of 80 to 90% were evaluated as "partial uneven transfer occurrence", and transfer efficiencies of 80% or less were evaluated as "transfer failure", and the relationship between the number of revolutions of the photosensitive body from development to transfer and the transfer efficiency thereof is overlapped on FIG. 4.

As a result of the above experiment, it is known that the optical reflection quantity of visible images on the photosensitive body decreases with evaporation of a surplus developer, reaches once the minimum value, then increases again, and approximates to a constant value. In the figure, the region A represents a condition in which a surplus developer is present excessively higher than the height of the surface of a deposit of solid components, the region B near the minimum value represents a condition in which the height of a deposit and the height of the surface of a developer give near levels, and the region C corresponds to a condition in which evaporation of a developer is further progressed, and the value to which the optical quantity curve showing start of increase comes ncar gradually is the optical reflection quantity value in complete dryness. As apparent from the figure, when the optical reflection quantity value is in the region C, namely, in the region of the minimum value or later, good transferred images are obtained.

Further, in actual full color image formation using four color-toner liquids, the optical reflection quantity and transfer efficiency of images were checked similarly as described above. As a result, the optical reflection quantity of images showed the same change as in FIG. 4, and it was found that good transfer property is obtained under condition within the range from the minimum value to asymptotic value. However, since the optical reflection quantity is obtained as an average value in the area irradiated with laser light, output voltage range reveals slight variation.

Moreover, in an image pattern of which 80% of visible images were occupied by regions in which toners of four colors were overlapped and the thickness of the toner layer was high, an good transferred image was obtained by such setting that the reflection light quantity corresponded to 60% between the minimum value and the asymptotic value.

Example 2

The reflection light quantity of a visible image obtained by repeatedly developing images with toner liquids of four colors and overlapping them was previously measured according to the same operation as in Example 1 using the electrophotographic image printing apparatus 120. Here, in this image pattern, 80% of the visual images were occupied by regions in which toners of four colors were overlapped and the thickness of the toner layer was high. The rotation rate of the sponge roller made of urethane rubber and the wind blow rate of the air knife were set so that the optical reflection quantity from the image immediately before transfer was about 70% [=0.70×(0.40 V−0.14 V)+0.14 V] while regarding the output voltage (0.14 V) of the minimum value of the optical reflection quantity obtained from this image as 0% and the output voltage (0.40 V) of the asymptotic value thereof as 100%.

An image pattern of the maximum concentration in which toners of four colors were laminated in the whole region was developed using the above apparatus after setting, and an image after drying was transferred to paper, to find that the transfer efficiency of the image was 95%. Further, while maintaining the above setting, an image pattern of lower concentration in which the whole region was made of a monochrome toner was developed, and an image after drying was transferred to paper, to find that the transfer efficiency of the image was 100%. Consequently, it is known that good transfer property is obtained in any case.

As described above, according to the present invention, an image formed using a liquid developer can be transferred at high efficiency to a recording medium, and an image forming apparatus which shows high reliability in transfer and can form an image of high image quality can be provided.

This application claims benefit of priority under 35 U.S.C. § 119 to Japanese Patent Application No. 2000-27849, filed on Sep. 13, 2000, the entire Contents of which are incorporated by reference herein.

It must be understood that the invention is in no way limited to the above embodiments and that many changes may be brought about therein without departing from the scope of the invention as defined by the appended claims.

What is claimed is:

1. A method of printing an image on a print medium with a liquid developer which comprises a liquid carrier and a toner dispersed in the liquid carrier, comprising:

forming a toner image probably containing the liquid carrier, from the liquid developer;

removing the liquid carrier from the toner image;

transferring the toner image to the print medium;

projecting light radiation on the toner image to be transferred, to measure an optical reflection from the toner image to be transferred; and estimating transfer suitability of the toner image to be transferred, by means of the measured optical reflection from the toner image to be transferred, for appropriately controlling the extent of the removing of the liquid carrier.

2. The printing method of claim 1, further comprising:

previously making a calibration chart showing a relationship between the optical reflection from the toner image and the extent of the removing of the liquid carrier from the toner image, wherein the estimating of the transfer suitability comprises:

checking the measured optical reflection with the calibration chart.

3. The printing method of claim 2, wherein the making of the calibration chart comprises:

repeatedly measuring the optical reflection from the toner image, while changing the extent of the removing of the liquid carrier from the toner image.

4. The printing method of claim 2, wherein the calibration chart has a graphic curve comprising a descending part, a minimum part, an ascending part and an asymptotic part along which the optical reflection changes in due order according as the extent of the removing of the liquid carrier advances, and the transfer suitability of the toner image, at the estimating, is estimated to be high when the measured optical reflection of the toner image is correspondent to a value which belongs to one of the minimum part, the ascending part and the asymptotic part of the graphic curve.

5. The printing method of claim 4, wherein the transfer suitability of the toner image, at the estimating, is estimated to be high when the measured optical reflection of the toner image is correspondent to a value which belongs to the ascending part of the graphic curve.

6. The printing method of claim 4, wherein the transfer suitability of the toner image, at the estimating, is estimated to be the highest when, regarding the value of the minimum part as 0 percent, and regarding the value of the asymptotic part as 100 percent, the measured optical reflection of the toner image is correspondent to a value of 30 percent to 80 percent.

7. The printing method of claim 4, further comprising:

controlling the extent of the removing of the liquid carrier appropriately in accordance with the estimated transfer suitability.

8. The printing method of claim 7, wherein the controlling of the removing of the liquid carrier comprises:

changing the extent of the removing of the liquid carrier to make high the estimated transfer suitability for the toner image to be transferred.

9. The printing method of claim 7, wherein the controlling or the removing of the liquid carrier comprises:

regulating a rate or a time period for removing the liquid carrier from the toner image, in order to transfer the toner image to the print medium at a proper transferring timing.

10. The printing method of claim 1, wherein the removing of the liquid carrier comprises:

drying the toner image by air blow.

11. The printing method of claim 1, wherein the removing of the liquid carrier comprises:

heating the toner image to evaporate the liquid carrier.

12. The printing method of claim 1, wherein the toner of the liquid developer has electrostatic charge, and the forming of the toner image comprises:

providing an electrostatic latent image to be developed into the toner image with the charged toner.

13. A printing apparatus for printing an image onto a print medium with use of a liquid developer which contains a liquid carrier and a toner being dispersed in the liquid carrier, comprising:

an image forming system which forms a toner image probably containing the liquid carrier, from the liquid developer;

a carrier remover which removes the liquid carrier from the toner image, the carrier remover being controllable to change the extent of removing the liquid carrier;

a transfer member which transfers the toner image from the image forming system to the print medium; and an optical instrument which projects light radiation on the toner image to be transferred and measures an optical reflection from the toner image to be transferred, in order to appropriately control the carrier remover.

14. The printing apparatus of claim 13, wherein a transfer suitability of the toner image to be transferred is estimated by means of the measured optical reflection from the toner image to be transferred, and the carrier remover is constructed to be controlled in accordance with the transfer suitability of the toner image to be transferred.

15. The printing apparatus of claim 13, wherein the optical instrument is constructed to be detachable from the printing apparatus, in order to attach the optical instrument only when the carrier remover is controlled.

16. The printing apparatus of claim 15, further comprising a casing constructed to be detachable from the printing apparatus and enclose the optical instrument.

17. The printing apparatus of claim 13, wherein the carrier remover comprises at least one of:

an air blower which supplies air blow to the toner image to dry the toner image; and a heating system which heats the toner image to evaporate the liquid carrier.

18. The printing apparatus of claim 13, wherein the transfer member comprises an intermediate transfer drum interposing between the image forming system and the print medium to temporarily receives the toner image from the image forming system and subsequently transfer the toner image to the print medium.

19. The printing apparatus or claim 13, wherein the toner of the liquid developer has electrostatic charge, and the image forming system comprises an electrophotographic system which provides an electrostatic latent image to be developed into the toner image with the charged toner.

* * * * *